US007866018B2

(12) United States Patent
Dear

(10) Patent No.: US 7,866,018 B2
(45) Date of Patent: Jan. 11, 2011

(54) FASTENER INSTALLATION TOOL INCLUDING MEANS FOR DISABLING THE TOOL

(75) Inventor: Aiden Robert Dear, Hitchin (GB)

(73) Assignee: Avdel UK Limited (GB)

( * ) Notice: Subject to any disclaimer, the term of this patent is extended or adjusted under 35 U.S.C. 154(b) by 487 days.

(21) Appl. No.: 11/909,688

(22) PCT Filed: Mar. 7, 2006

(86) PCT No.: PCT/GB2006/000808

§ 371 (c)(1),
(2), (4) Date: Dec. 20, 2007

(87) PCT Pub. No.: WO2006/106286

PCT Pub. Date: Oct. 12, 2006

(65) Prior Publication Data

US 2010/0139068 A1 Jun. 10, 2010

(30) Foreign Application Priority Data

Apr. 2, 2005 (GB) ..... 0506738.4

(51) Int. Cl.
*B21J 15/06* (2006.01)
*B21J 15/28* (2006.01)

(52) U.S. Cl. ..... 29/243.523; 29/243.525

(58) Field of Classification Search ..... 29/243.521, 29/243.523, 243.524, 243.525, 243.526, 29/243.53; 72/391.2, 391.4, 391.6
See application file for complete search history.

(56) References Cited

U.S. PATENT DOCUMENTS 4,088,003 A 5/1978 Schwab
4,118,969 A * 10/1978 Corbett ..... 29/243.525
4,598,571 A 7/1986 Oefinger
4,864,839 A 9/1989 Schwab
5,031,508 A 7/1991 Babyak
5,500,990 A 3/1996 Wihan
6,272,899 B1 8/2001 Bentivogli
6,532,635 B1 * 3/2003 Gregory ..... 29/243.523

FOREIGN PATENT DOCUMENTS

EP 0130040 A2 1/1985
EP 0302128 A1 2/1989
EP 0478162 A1 4/1992
EP 1013358 A2 6/2000
GB 2130514 A 6/1984
WO 96/38245 A1 12/1996
WO 01/24956 A1 4/2001

OTHER PUBLICATIONS

International Search Report and Written Opinion which issued in connection with corresponding Application No. PCT/GB2006/000808 on May 3, 2006.

European Search Report which issued in connection with corresponding Application No. GB0506738.4 on May 24, 2005.

* cited by examiner

*Primary Examiner*—David B Jones
(74) *Attorney, Agent, or Firm*—Clark Hill PLC

(57) ABSTRACT

In a fastener tool, a constant flow of compressed air is supplied. When the tool is not in use however the constant flow of compressed air results in waste. The tool is therefore provided with a trigger that is adapted when in a first position to stop the flow of compressed air through the tool in order to disable the tool and when in a second position to actuate installation means.

3 Claims, 4 Drawing Sheets

FASTENER INSTALLATION TOOL INCLUDING MEANS FOR DISABLING THE TOOL

RELATED/PRIORITY APPLICATION

This application is a National Phase filing regarding International Application No. PCT/GB2006/000808, filed on Mar. 7, 2006. International Application No. PCT/GB2006/000808 relies upon British Application No. 0506738.4, filed on Apr. 2, 2005, for priority.

This invention relates to fastener installation tools. The invention is particularly applicable to fastener installation tools of the type which are pneumatically powered to install a blind rivet or bolt by a relative pulling action, and may incorporate a pneumatic/hydraulic intensifier to actuate hydraulically the pulling stroke of a head piston which provides the relative pulling action.

Such tools have been well known for many years. A typical example of such a tool is described in our earlier specification WO 96/38245, to which the reader is referred for further information about the construction, operation and practical requirements of such tools.

Usually, in a blind rivet tool of this nature, a flow of compressed air is supplied to the tool by a hose and coupling and subsequently routed through a central bore found within the head piston in order to propel broken off rivet stems into a collecting bottle at the rear of the riveting apparatus. Additionally, compressed air from the same source is routed through a vacuum generator which creates a vacuum to hold the blind rivets in place in the gun before riveting.

It is advantageous to be able to switch off the supply of compressed air to the vacuum generator and stem ejection system when the tool is not going to be used for a period of time in order to prevent waste of the compressed air and the associated noise of exhaust air.

In conventional fastener installation tools it is possible to control the air supply to the stem ejection system and vacuum generator through manual adjustment of a valve through which air is routed to the bore and rear of the piston. However, manual adjustment of this valve requires the use of a screwdriver or other tool which is not convenient to the general user. Also the valve is intended and designed only to be used to accommodate differing air flows required by differently dimensioned fasteners in the tool.

Alternatively, the hose supplying the flow of compressed air to the tool has a shut-off valve which can be used to stop air flow into the tool completely. This, like the turning off of the valve described above, requires a conscious effort on the part of the operator as neither action is associated with normal tool usage.

A fastener installation tool is described in EP 1013358 and has two "triggers". The first trigger activates a mechanism for installing a fastener. The second trigger, located separately from the first trigger, controls flow of air into the tool. When depressed the second trigger activates a "control bolt" to provide a compressed air connection. When released the control bolt is deactivated and the flow of compressed air is stopped. The two triggers are set apart from each other with the second trigger set at the front of the tool's handle.

German Patent DE100 11 305 and Utility Model DE 200 11 344 describe a similar mechanism having a sensor at the front of the handle which activates a flow of compressed air when the handle is gripped. A second, separate, trigger is provided for activating the fastener installation mechanism.

According to one aspect of the invention there is provided a fastener installation tool for installing blind fasteners, the tool comprising a trigger connected to an air valve for controlling a flow of air through the tool and actuating means for installing fasteners, the trigger having a first position wherein the valve is configured to prevent air flow through the tool and a second position in which the trigger activates the actuating means to cause installation of a fastener and the valve is configured to permit air flow through the tool.

Preferably the trigger also has a neutral position in which air flow through the tool is enabled without activation of the actuating means. The valve may be a rotary valve.

Preferably the trigger is provided with an extension directed into the tool handle which terminates in a yoke formation and which engages a pin extending from the valve generally parallel with its rotational axis. Preferably the yoke and pin are engaged such that when the trigger is in the second position no load is placed on the pin and the position of the valve is not altered when moving the trigger between the neutral position and the second position.

According to another aspect of the invention there is provided a fastener installation tool comprising: a trigger rotatably mounted at a pivot point, the trigger including an extension directed into the tool, the extension having a yoke at its distal end, a rotary valve including a passageway for air to flow through and a pin extending from the valve in a direction generally parallel to its axis of rotation, wherein the yoke is arranged to engage the pin such that movement of the trigger causes movement of the valve and the interruption of the passageway. The trigger being further adapted to actuate means for installing fasteners when in a second position.

The general construction of the hand-held riveting tool is similar to that described in WO 96/38345 to which the reader is referred for a description of the construction and operation of the tool. The tool includes a pneumatic/hydraulic intensifier, fed by compressed air through a hose. When an external trigger is pressed, the intensifier is actuated to drive a head piston along a bore to cause a jaw-assembly to grip and pull the pin-tail of a blind rivet which has been inserted in the nosetip of the tool. The body of the blind rivet deforms, and eventually the pin of the rivet breaks and the jaws retract with the broken off pin-tail. The jaws release the pin-tail which is ejected rearwardly along a tube which extends along the centre of bore. The tube leads into a bore through a connector block which is secured on the rear end of the bore.

In order to propel the pin-tail down the bore through a connector block to a collector bottle, air under pressure is constantly fed along a bore to the bore behind the piston.

Figure 1:
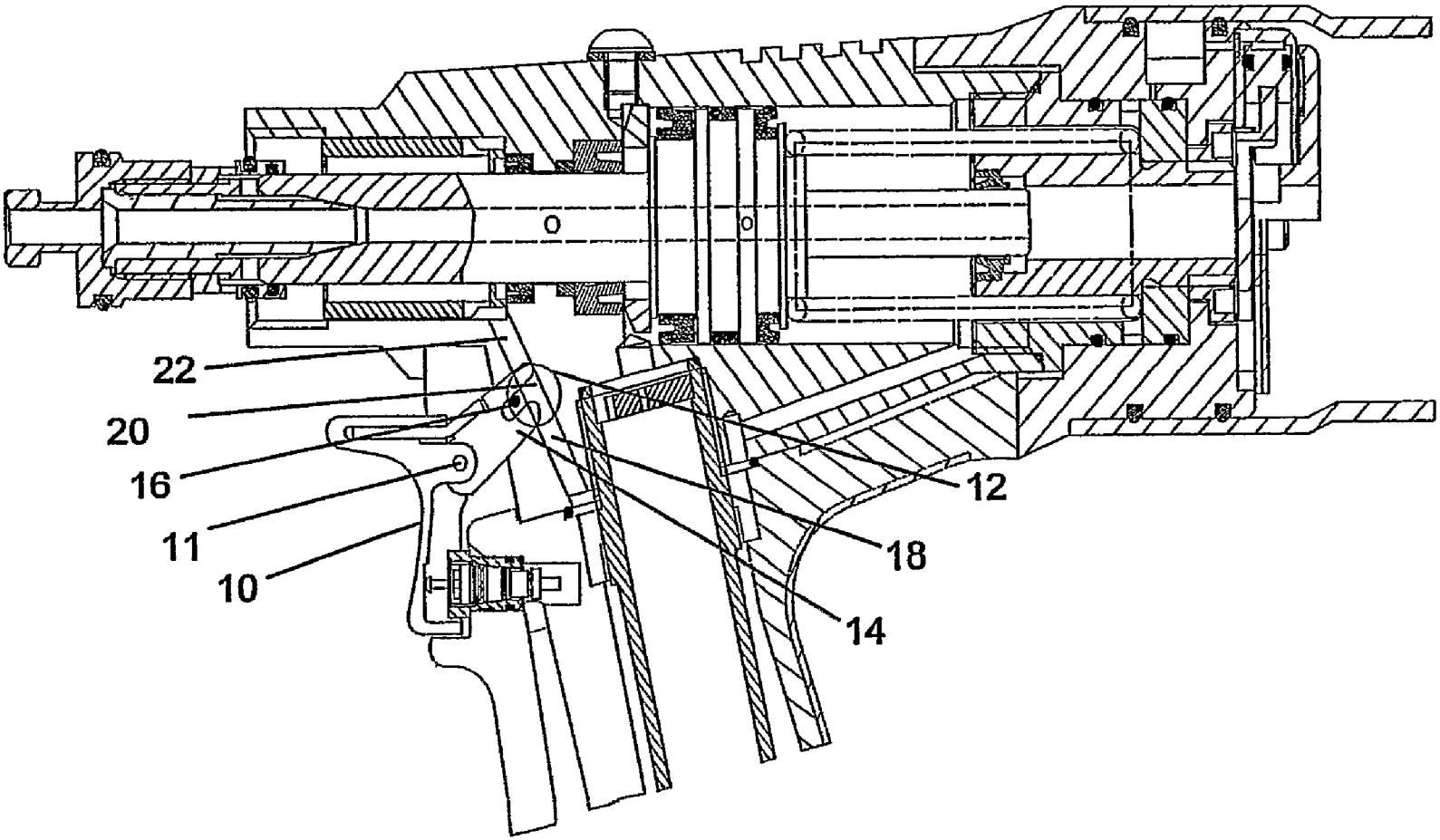
FIG. 1 is a longitudinal section through the head of a blind rivet tool in accordance with a first embodiment of the invention.
Figure 2:
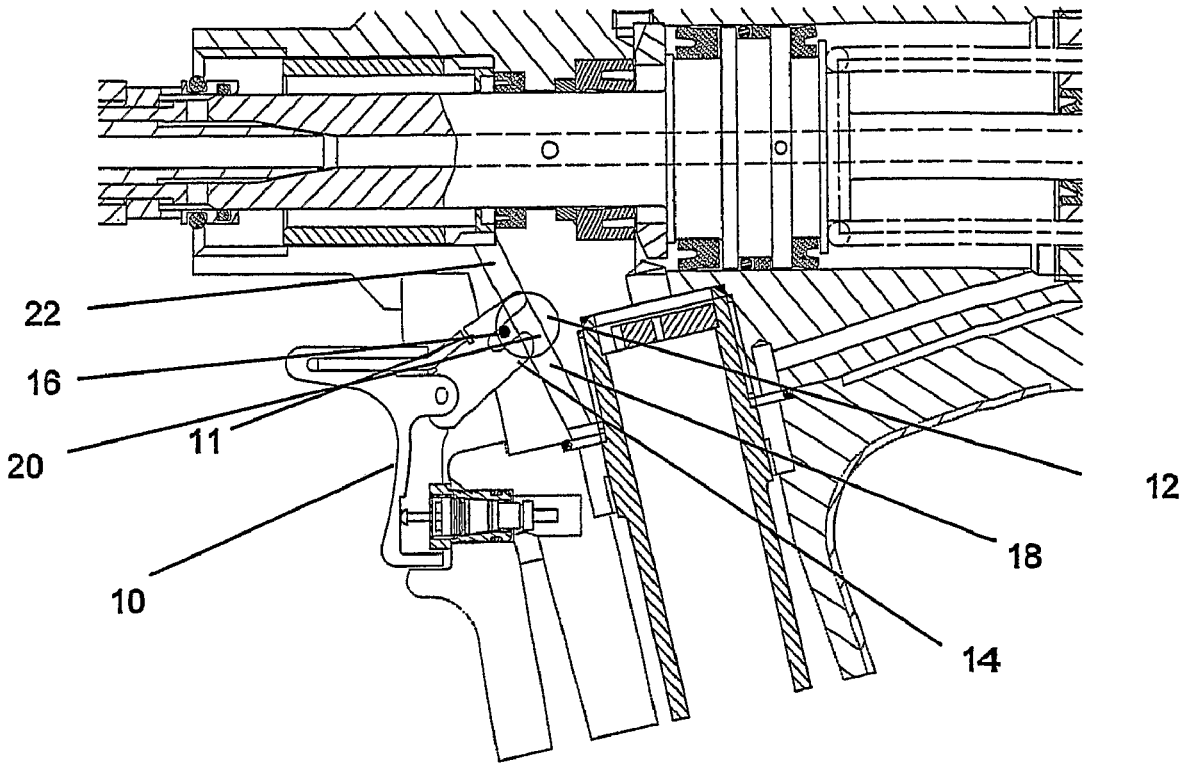
FIG. 2 is a longitudinal section through the head of a blind rivet tool with the trigger in a neutral position.

In the new arrangement a trigger 10 is linked to a rotary valve 12 and has three possible positions which are shown in FIGS. 1 to 4 respectively In a neutral position as shown in FIGS. 1 and 2, air flows through to the vacuum generator and stem ejection system but the riveting action does not occur.

Figure 3:
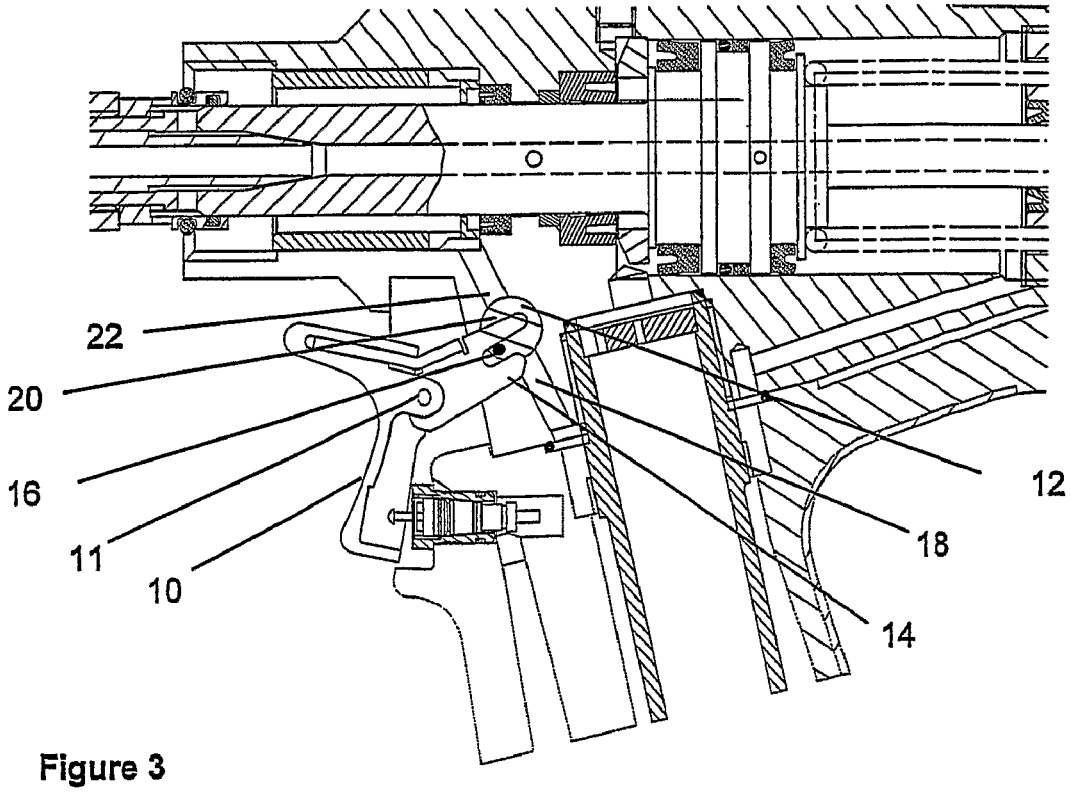
FIG. 3 is a longitudinal section through the head of a blind rivet tool with the trigger in a first position.

In a first position as shown in FIG. 3, the vacuum generator and stem ejection system is deactivated by shutting off the air supply through the rotary valve.

Figure 4:
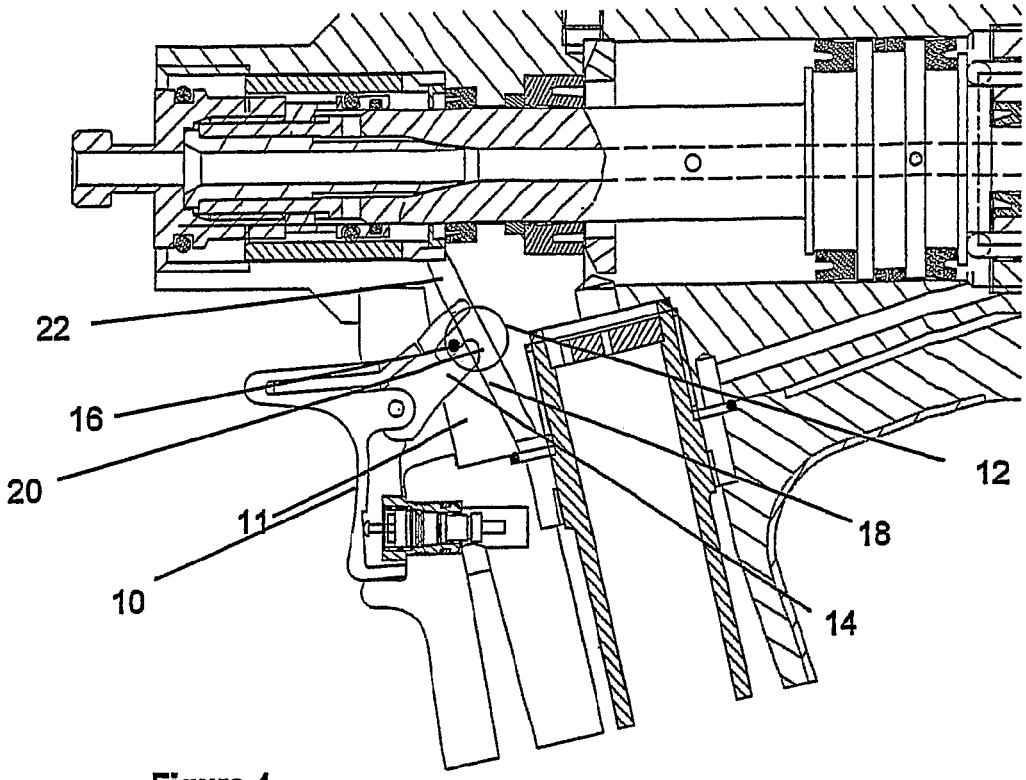
FIG. 4 is a longitudinal section through the head of a blind rivet tool with the trigger in a second position.

In a second position, FIG. 4, the tool is used to install a rivet.

Preferably the trigger 10 is rotatably mounted at a pivot point 11 in the tool and has an extension having a yoke 14 at its distal end. The yoke 14 engages a pin 16 on the valve thereby allowing rotational movement of the trigger 14 to cause rotation of the valve 12.

In FIGS. 1 and 2 the trigger 10 is in a "neutral position". In this position the valve 12 is open and allows communication of compressed air from an inlet 18 to the vacuum generator stem-ejector mechanism. The air passes from the inlet 18 through a bore 20 in the valve 12 to outlet 22 which leads to the vacuum generator and stem-ejector mechanism.

A rotational movement of the trigger 10 causes a corresponding movement of the extension and yoke 14. This results in movement of the pin 16 and rotation of the valve 12. The rotation of the valve alters the positioning of the bore relative to the inlet 18 and outlet 22 as shown in FIG. 3. When the tool is not to be used for a time, the operator can use this function to turn off the air supply to the vacuum generator and the stem-ejection mechanism.

This positioning of the valve means that the compressed air cannot pass through the bore in the valve 12 and hence the vacuum system is disabled and wastage of compressed air prevented.

FIG. 4 is shown for completeness and illustrates a second position of the trigger. In FIG. 4 the trigger 10 has been depressed thereby to actuate the intensifier and cause installation of a blind rivet as previously described.

Figure 5:
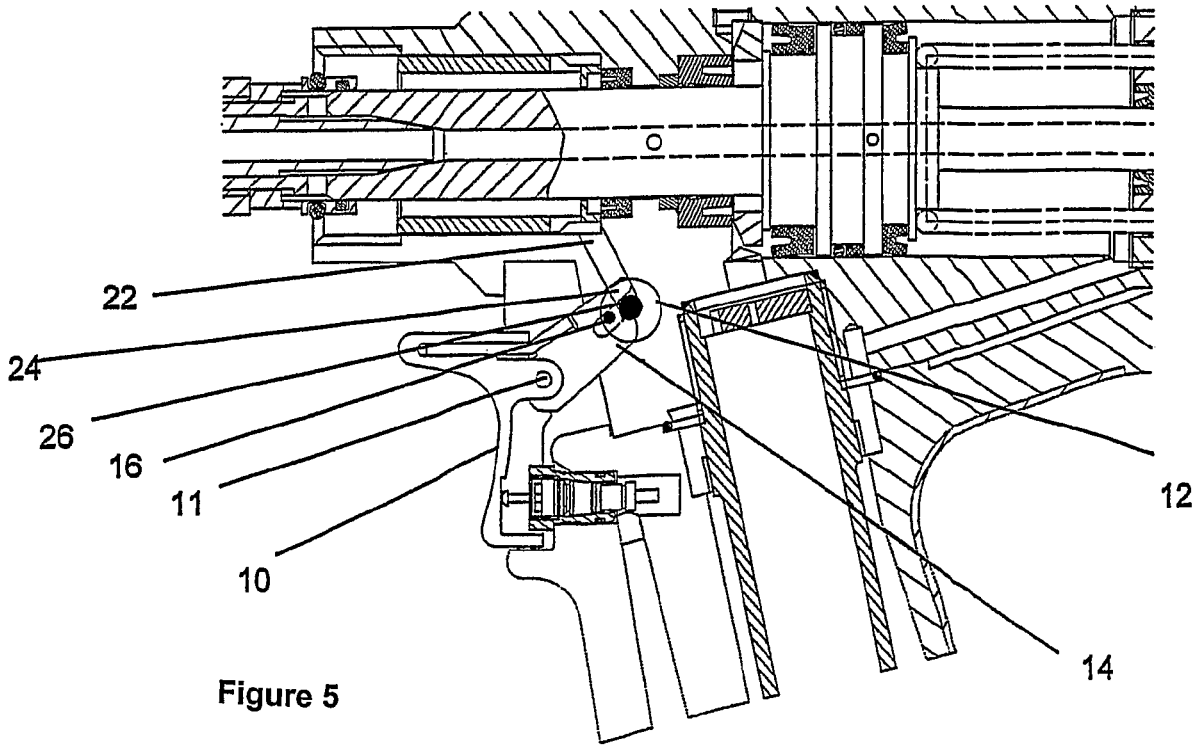
FIG. 5 is a longitudinal section through the head of a blind rivet tool in accordance with an alternative embodiment of the invention with the trigger in the neutral position.
Figure 6:
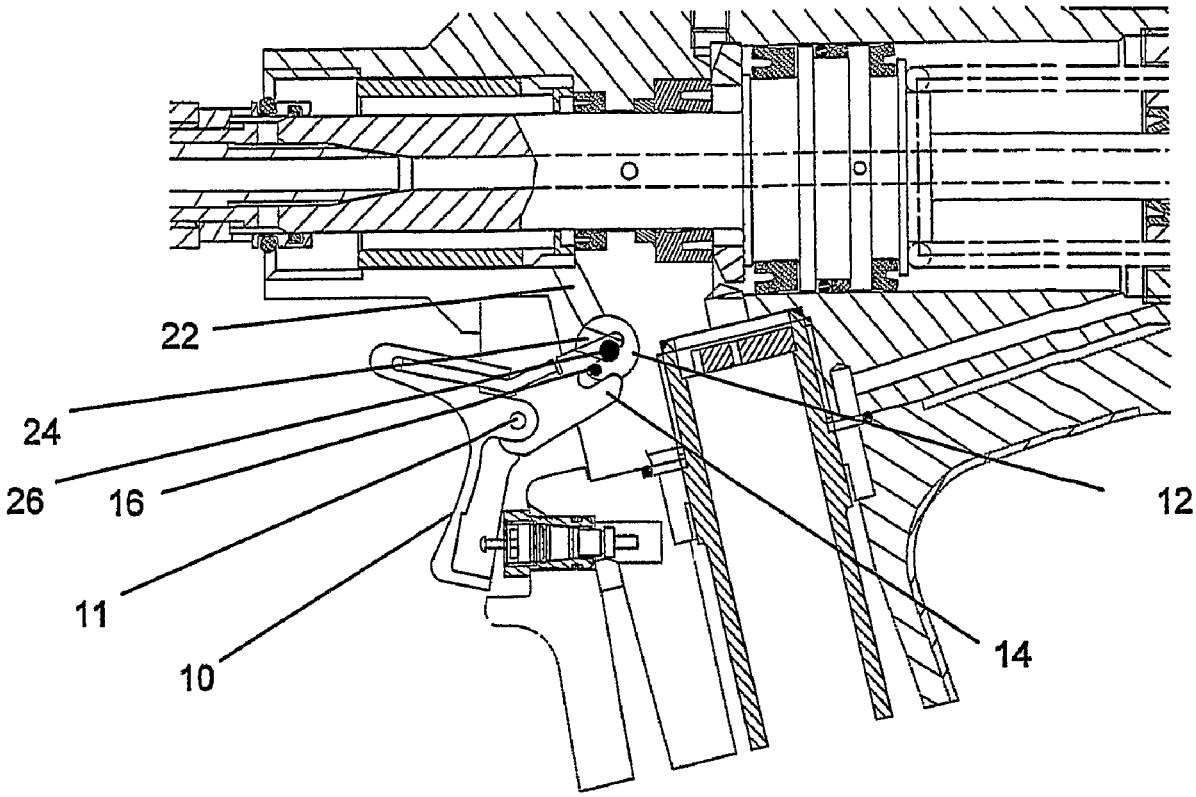
FIG. 6 is a longitudinal section through the head of a blind rivet tool with the trigger of the alternative embodiment in the first position.

Advantageously the yoke 14 and pin 16 are not engaged so precisely that movement of the yoke 14 necessarily causes motion of the pin 16 and valve 12. Rather, it is preferable to provide a gap between the yoke 14 and pin 16. This gap should be configured such that when the trigger 10 is moved to being used to initiate installation of a fastener, the rotational movement of the yoke 14 does not cause any significant movement of the pin 16. This means that the passage of air through the valve to the vacuum generator and stem ejection mechanism is not affected when the trigger 10 is in its second position and the performance of the tool is not affected by variations in air flow whilst it is being used. Furthermore, no additional load is applied to the trigger finger during normal tool operation FIGS. 5 and 6 illustrate an alternative embodiment of the invention. In FIGS. 4 and 5 the air inlet 26 to the valve 12 is configured such that rotation of the valve does not affect the flow of air into the valve 12. In FIG. 4 the trigger 10 is in a neutral position and the valve bore 24 is aligned with the outlet 22 allowing compressed air to flow from the inlet 26 to the vacuum generator.

In FIG. 6 the trigger 10 has been rotated about a pivot point 11 into a first position. This, as described above, causes a rotational motion of the yoke 14, and consequent motion of the pin 16 and valve 12. Therefore, in a similar manner as shown in FIG. 2 the valve 12 is rotated so that the bore 24 and the outlet 22 are no longer aligned. This stops the flow of compressed air to the outlet 22 and hence the vacuum generator and stem ejection system, thereby preventing wastage of compressed air.

The invention claimed is:

1. A fastener installation tool for installing blind fasteners, the tool comprising a tool handle, a trigger and an air valve, wherein the trigger is connected to the air valve and the air valve controls a flow of air through the tool, and wherein the tool further comprises an actuating means for installing fasteners, wherein pressing of the trigger causes actuation of the actuating means, the trigger having:

(a) a first position wherein the valve is configured to prevent air flow through the tool;

(b) a second position in which the trigger activates the actuating means to cause installation of the fastener and the valve is configured to permit air flow through the tool; and (c) a neutral position in which air flow through the tool is enabled without activation of the actuating means wherein said air valve is a rotary valve, and wherein the trigger has an extension directed into the tool handle, wherein the extension terminations in a yoke formation at a distal end of the extension; and wherein the yoke formation engages a pin which extends from the valve generally parallel with a rotational axis of the valve.

2. A fastener installation tool as claimed in claim 1 wherein the yoke and pin are engaged such that when the trigger is in the second position no load is placed on the pin and the position of the valve is not altered when moving the trigger between the neutral position and the second position.

3. A fastener installation tool as claimed in claim 1, wherein the trigger is rotatable mounted, and wherein the rotary valve includes a passageway for air to flow through, wherein the yoke is arranged to engage the pin such that movement of the trigger into the first position causes movement of the valve and the interruption of the passageway.

* * * * *